US008537170B2

(12) United States Patent
Ryu

(10) Patent No.: US 8,537,170 B2
(45) Date of Patent: Sep. 17, 2013

(54) ORGANIC LIGHT EMITTING DISPLAY WITH REDUCED DRIVING FREQUENCY AND METHOD OF DRIVING THE SAME

(75) Inventor: Do Hyung Ryu, Suwon (KR)

(73) Assignee: Samsung Display Co., Ltd., Yongin-si (KR)

( * ) Notice: Subject to any disclaimer, the term of this patent is extended or adjusted under 35 U.S.C. 154(b) by 711 days.

(21) Appl. No.: 12/265,718

(22) Filed: Nov. 5, 2008

(65) Prior Publication Data

US 2009/0066686 A1 Mar. 12, 2009

Related U.S. Application Data

(62) Division of application No. 11/204,757, filed on Aug. 15, 2005, now abandoned.

(30) Foreign Application Priority Data

Aug. 30, 2004 (KR) ..... 2004-68403

(51) Int. Cl.
*G09G 3/30* (2006.01)

(52) U.S. Cl.
USPC ..... 345/539; 345/560

(58) Field of Classification Search
USPC ..... 345/76, 204, 103, 539, 560
See application file for complete search history.

(56) References Cited

U.S. PATENT DOCUMENTS 5,192,945 A * 3/1993 Kusada ..... 345/88
5,801,674 A 9/1998 Shimizu
6,225,970 B1 * 5/2001 Song et al. ..... 345/103
6,670,771 B2 12/2003 Shin et al.
6,750,838 B1 6/2004 Hirakata
2004/0080478 A1 4/2004 Akimoto

FOREIGN PATENT DOCUMENTS

JP 3-186890 8/1991
JP 5-232898 9/1993
JP 6-295163 10/1994
JP 11-45076 2/1999

(Continued)

OTHER PUBLICATIONS

Singapore Office action dated Jul. 4, 2008, for corresponding Chinese application 200510096591.8 w/Eng. translation.

(Continued)

*Primary Examiner* — Allison Walthall
(74) *Attorney, Agent, or Firm* — Christie, Parker & Hale, LLP

(57) ABSTRACT

An organic light emitting display and a method of driving the same, in which a driving frequency is lowered and at the same time a production cost is reduced. The organic light emitting display includes: a display region divided into a left part and a right part; a first data driver adapted to supply a data signal to data lines of the left part; a second data driver adapted to supply the data signal to data lines of the right part; and first and second memory groups wherein, when one of the first and second memory groups stores data to be supplied to the left and right parts therein, another one of the first and second memory groups supplies data to the first and second drivers, and wherein, when one of the first and second memory groups receives a reading signal in parallel, another one of the first and second memory groups receives a writing signal in series. With this configuration, the frequency of a clock included in a reading signal supplied to a line memory is lowered, thereby reducing a production cost.

5 Claims, 12 Drawing Sheets

(56) References Cited

FOREIGN PATENT DOCUMENTS

| | | |
|---|---|---|
| JP | 2000-259124 | 9/2000 |
| KR | 1993-0014236 | 7/1993 |
| KR | 1998-068076 | 12/1998 |
| KR | 10-2004-0053733 | 6/2004 |

OTHER PUBLICATIONS

U.S. Office action dated Feb. 2, 2009, for parent U.S. Appl. No. 11/204,757.

U.S. Office action dated Jul. 8, 2009, for parent U.S. Appl. No. 11/204,757.

Patent Abstracts of Japan; Publication No. 2000-259124; Publication Date Sep. 22, 2000; in the name of Saito, et al.

Korean Patent Abstract, Publication No. 1020040053733 A, dated Jun. 24, 2004, in the name of Gyeong Seok Kim et al.

Patent Abstracts of Japan, Publication No. 05-232898, dated Sep. 10, 1993, in the name of Hiroaki Moriyama.

Patent Abstracts of Japan, Publication No. 11-045076, dated Feb. 16, 1999, in the name of Yoshiharu Hirakata.

* cited by examiner

ORGANIC LIGHT EMITTING DISPLAY WITH REDUCED DRIVING FREQUENCY AND METHOD OF DRIVING THE SAME

CROSS-REFERENCE TO RELATED APPLICATION

This application is a divisional of U.S. patent application Ser. No. 11/204,757, filed on Aug. 15, 2005 now abandoned which claims priority to and the benefit of Korean Patent Application No. 10-2004-0068403, filed on Aug. 30, 2004, in the Korean Intellectual Property Office, the entire content of which is incorporated herein by reference.

BACKGROUND

1. Field of the Invention

The present invention relates to an organic light emitting display and a method of driving the same, and more particularly, to an organic light emitting display and a method of driving the same, in which a driving frequency is lowered and at the same time a production cost is reduced.

2. Discussion of Related Art

Recently, various flat panel displays have been developed to substitute for a cathode ray tube (CRT) display because the CRT display is relatively heavy and bulky. The flat panel display includes a liquid crystal display (LCD), a field emission display (FED), a plasma display panel (PDP), and an organic light emitting display.

Among the flat panel displays, the organic light emitting display can emit light for itself by electron-hole recombination. Such an organic light emitting display has advantages in that response time is relatively fast and power consumption is relatively low. Generally, the organic light emitting display employs a thin film transistor (TFT) provided in each pixel for supplying a current corresponding to a data signal to a light emitting device, thereby allowing the light emitting device to emit light.

FIG. 1 illustrates a conventional organic light emitting display.

Referring to FIG. 1, a conventional organic light emitting display includes a display region 30 having a plurality of pixels 1 formed adjacent to respective regions where a plurality of scan lines S1 through Sn and a plurality of data lines D1 through Dm crossed each other, where n and m are natural numbers; a scan driver 20 adapted to drive the scan lines S1 through Sn; a data driver 10 adapted to drive the data lines D1 through Dm; and a controller 40 adapted to control the scan driver 20 and the data driver 10.

The scan driver 20 generates a scan signal(s) for driving the scan lines S1 through Sn in response to a scan control signal (s) GCS transmitted from the controller 40, and supplies the scan signals to the scan lines S1 through Sn in sequence.

The data driver 10 receives data control signals DCS and data Data from the controller 40. Then, the data driver 10 is controlled by the data control signals DCS to convert the data Data into voltage (or current), thereby outputting a data signal (s) to the data lines D1 through Dm. At this time, the data driver 10 supplies the data signal corresponding to one horizontal line per horizontal period to the data lines D1 through Dm.

In operation, a pixel 1 is selected when a scan signal is transmitted to a scan line S, and emits light corresponding to a data signal transmitted to a data line D. For this, each pixel 1 includes at least one switching device and a capacitor.

The controller 40 generates the data control signals DCS and the scan control signal(s) GCS in response to external synchronization signals. Here, the data control signals DCS are transmitted to the data driver 10, and the scan control signal GCS is transmitted to the scan driver 20.

Further, the controller 40 temporarily stores external data Data, and supplies the stored data Data to the data driver 10. For this, the controller 40 includes line memories 42 and 44 as shown in FIG. 2A. Additionally, the temporarily stored data Data can be supplied to a gamma generator (not shown). Then, the gamma generator generates the data signal in response to a gradation level of the data Data, and supplies the data signal to the data driver 10.

FIGS. 2A and 2B illustrate line memories provided in a controller of a conventional organic light emitting display.

Referring to FIGS. 2A and 2B, the controller 40 includes the first line memory 42 and the second line memory 44. Each of the line memories 42 and 44 is set to have a certain capacity to store data corresponding to one horizontal line. Here, the first line memory 42 and the second line memory 44 repeatedly alternate between writing and reading operations, alternately.

For example, as shown in FIG. 2A, while a writing signal W is transmitted to the first line memory 42, a reading signal R is transmitted to the second line memory 44. Here, the writing signal W and the reading signal R include various signals such as an address signal, a clock signal, etc. When the writing signal W is transmitted to the first line memory 42, the first line memory 42 stores external data Data corresponding to one horizontal line in sequence. Further, when the reading signal R is transmitted to the second line memory 44, the second line memory 44 supplies the data Data stored therein corresponding to one horizontal line to the data driver 10.

On the other hand, as shown in FIG. 2B, while the reading signal R is transmitted to the first line memory 42, the writing signal W is transmitted to the second line memory 44. When the reading signal R is transmitted to the first line memory 42, the first line memory 42 supplies the data Data stored therein corresponding to one horizontal line to the data driver 10. Further, when the writing signal W is transmitted to the second line memory 44, the second line memory 44 stores the external data Data corresponding to one horizontal line in sequence.

That is, the conventional organic light emitting display shown in FIG. 1 employs the line memories 42 and 44 to temporarily store the data Data and supply the stored data Data to the data driver 10, thereby displaying a predetermined image. Here, the line memories 42 and 44 store a plurality of data Data and supply the stored data Data to the data driver 10 per one horizontal period 1H, so that the reading signal R and the writing signal W have a high clock frequency.

Thus, because the clocks included in the reading signal R and the writing signal W have high frequency, an electromagnetic interference (EMI) or the like is generated, thereby deteriorating a driving operation of the organic light emitting display. Further, because each of the reading signal R and the writing signal W has the high clock frequency, a need arises for a high performance integrated circuit (IC) which can be stably driven at the high frequency, and thus a problem arises in that a production cost is increased. To solve this problem, there has been proposed an organic light emitting display as shown in FIG. 3.

FIG. 3 illustrates another conventional organic light emitting display. In FIG. 3, like numerals as those in FIG. 1 refer to like elements, and descriptions for elements that are substantially similar to those described above for the display of FIG. 1 will be avoided.

Referring to FIG. 3, the organic light emitting display includes a display region 30 having a plurality of pixels 1 formed adjacent to respective regions where a plurality of scan lines S1 through Sn and a plurality of data lines D1 through Dm crossed each other, where n and m are natural numbers; a scan driver 20 adapted to drive the scan lines S1 through Sn; a first data driver 12 adapted to drive odd numbered data lines D1, D3, . . . , Dm−1; a second data driver 14 adapted to drive even numbered data lines D2, D4, . . . , Dm; and a controller 50 adapted to control the scan driver 20, the first data driver 12, and the second data driver 14.

The scan driver 20 generates a scan signal(s) for driving the scan lines S1 through Sn in response to a scan control signal (s) GCS transmitted from the controller 50, and supplies the scan signals to the scan lines S1 through Sn in sequence.

The first data driver 12 receives data control signals DCS and odd numbered data Data(o) from the controller 50. Then, the first data driver 12 is controlled by the data control signals DCS to convert the odd numbered data Data(o) into voltage (or current), thereby outputting an odd numbered data signal (s) to the odd numbered data lines D1, D3, . . . , Dm−1. At this time, the first data driver 12 supplies the odd numbered data signal(s) corresponding to one horizontal line per horizontal period to the odd numbered data lines D1, D3, . . . , Dm−1.

In addition, the second data driver 14 receives the data control signals DCS and even numbered data Data(e) from the controller 50. Then, the second data driver 14 is controlled by the data control signals DCS to convert the even numbered data Data(e) into voltage (or current), thereby outputting an even numbered data signal(s) to the even numbered data lines D2, D4, . . . , Dm. At this time, the second data driver 14 supplies the even numbered data signal(s) corresponding to one horizontal line per horizontal period to the even numbered data lines D2, D4, . . . , Dm.

In operation, a pixel 1 is selected when a scan signal is transmitted to a scan line S, and emits light corresponding to a data signal transmitted to a data line D. For this, each pixel 1 includes at least one switching device and a capacitor.

The controller 50 generates the data control signals DCS and the scan control signal(s) GCS in response to external synchronization signals. Here, the data control signals DCS are transmitted to the first and second data drivers 12 and 14, and the scan control signal GCS is transmitted to the scan driver 20.

Further, the controller 50 temporarily stores external data Data as the odd numbered data Data(o) and the even numbered data Data(e), and supplies the stored odd numbered data Data(o) and the stored even numbered data Data(e) to the first and second data drivers 12 and 14, respectively. For this, the controller 50 includes line memory blocks 53 and 56 as shown in FIG. 4A. Additionally, the temporarily stored data Data can be supplied from the controller 50 to a gamma generator (not shown). Then, the gamma generator generates the data signal in response to a gradation level of the data Data, and supplies the data signal to the first and second data drivers 12 and 14.

FIGS. 4A and 4B illustrate line memories provided in a controller of a conventional organic light emitting display.

Referring to FIGS. 4A and 4B, the controller 50 includes the first line memory block 53 and the second line memory block 56. The first line memory block 53 includes a first memory 51 and a second memory 52. Each of the first and second memories 51 and 52 is set to have a certain capacity to store data corresponding to a half horizontal line. Here, the first memory 51 and the second memory 52 repeatedly alternate between writing and reading operations. Further, the second memory block 56 includes a third memory 54 and a fourth memory 55. Each of the third and fourth memories 54 and 55 is set to have a certain capacity to store data corresponding to a half horizontal line. Here, the third memory 54 and the fourth memory 55 repeatedly alternate between writing and reading operations.

For example, as shown in FIG. 4A, while a writing signal W is transmitted to the first and third memories 51 and 54, a reading signal R is transmitted to the second and fourth memories 52 and 55. When the writing signal W is transmitted to the first memory 51, the first memory 51 stores external odd numbered data Data(o) corresponding to one horizontal line in sequence. Further, when the writing signal W is transmitted to the third memory 54, the third memory 54 stores external even numbered data Data(e) corresponding to one horizontal line in sequence.

When the reading signal R is transmitted to the second memory 52, the second memory 52 supplies the odd numbered data Data(o) stored therein corresponding to one horizontal line to the first data driver 12. Here, the second memory 52 either outputs the odd numbered data Data(o) at the same time or in sequence. When the reading signal R is transmitted to the fourth memory 55, the fourth memory 55 supplies the even numbered data Data(e) stored therein corresponding to one horizontal line to the second data driver 14. Here, the fourth memory 55 either outputs the odd numbered data Data (e) at the same time or in sequence.

On the other hand, as shown in FIG. 4B, while the reading signal R is transmitted to the first and third memories 51 and 54, the writing signal W is transmitted to the second and fourth memories 52 and 55. When the reading signal R is transmitted to the first memory 51, the first memory 51 supplies the odd numbered data Data(o) stored therein for a previous horizontal period to the first data driver 12. When the reading signal R is transmitted to the third memory 54, the third memory 54 supplies the even numbered data Data(e) stored therein for the previous horizontal period to the second data driver 14.

When the writing signal W is transmitted to the second memory 52, the second memory 52 stores the external odd numbered data Data(o) therein corresponding to one horizontal line in sequence. When the writing signal W is transmitted to the fourth memory 55, the fourth memory 55 stores the even numbered data Data(e) therein corresponding to one horizontal line in sequence.

Thus, each of the conventional memories 51, 52, 54 and 55 stores odd or even numbered data Data(o) or Data(e), and supplies the stored odd or even numbered data Data(o) or Data(e) to the first data driver or the second data driver 12 or 14, so that the frequency of the clock included in the reading and writing signals R and W can be advantageously lowered by about half as compared with the organic light emitting display of FIG. 1. However, the conventional organic light emitting display of FIG. 3 is in need of different data drivers 12 and 14 to drive the odd numbered data lines D1, D3, . . . , Dm−1 and the even numbered data lines D2, D4, . . . , Dm, so that the picture quality may be deteriorated.

In more detail, the first data driver 12 and the second data driver 14 have to supply the odd numbered data signal and the even numbered data signal at the same time. However, the data control signals DCS are not transmitted to the first and second data drivers 12 and 14 at the same time due to line resistance or the like, and thus the odd numbered data signal and the even numbered data signal are transmitted at different times. Because as the odd numbered data signal and the even numbered data signal are not supplied at the same time, the picture quality is deteriorated by a unit of a vertical line.

Further, the odd numbered data lines D1, D3, . . . , Dm−1 and the even numbered data lines D2, D4, . . . , Dm are driven by the different data drivers 12 and 14, so that interference arises due to a capacitance equivalently formed between adjacent data lines D, and the picture quality may be further deteriorated.

SUMMARY OF THE INVENTION

Accordingly, an embodiment of the present invention provides an organic light emitting display and a method of driving the same, in which a driving frequency is lowered and at the same time a production cost is reduced.

One embodiment of the present invention provides an organic light emitting display including: a display region divided into a left part and a right part; a first data driver adapted to supply a data signal to data lines of the left part; a second data driver adapted to supply a data signal to data lines of the right part; and first and second memory groups, wherein, when one of the first and second memory groups stores data to be supplied to the left and right parts therein, another one of the first and second memory groups supplies data to the first and second data drivers, and, wherein, when one of the first and second memory groups receives a reading signal in parallel, another one of the first and second memory groups receives a writing signal in series.

One embodiment of the present invention provides an organic light emitting display including: a display region divided into a left part and a right part; a first data driver adapted to supply a data signal to data lines corresponding to the left part; a second data driver adapted to supply the data signal to data lines corresponding to the right part; first and third memories, wherein, when one of the first and third memories stores data to be supplied to the left part, another one of the first and third memories supplies data stored therein for the left part to the first data driver; and second and fourth memories, wherein, when one of the second and fourth memories stores data to be supplied to the right part, another one of the second and fourth memories supplies data stored therein for the right part to the second data driver, wherein a reading signal is supplied to one of the first and third memories and one of the second and fourth memories at the same time.

One embodiment of the present invention provides an organic light emitting display including: a display region divided into a left part and a right part; a first data driver adapted to supply a data signal to odd numbered data lines corresponding to the left part; a second data driver adapted to supply the data signal to odd numbered data lines corresponding to the right part; a third data driver adapted to supply the data signal to even numbered data lines corresponding to the left part; a fourth data driver adapted to supply the data signal to even numbered data lines corresponding to the right part; a first line memory block adapted to store odd numbered data to be supplied to the left and right parts in sequence in response to a writing signal and to output odd numbered data stored therein for the left and right parts at the same time in response to a reading signal; and a second line memory block adapted to store even numbered data to be supplied to the left and right parts in sequence in response to the writing signal and to output even numbered data stored therein for the left and right parts at the same time in response to the reading signal.

One embodiment of the present invention provides a method of driving an organic light emitting display. The method includes: storing data to be supplied to a left part of a display region in a first memory in response to a writing signal; storing data to be supplied to a right part of the display region in a second memory in response to a carry signal supplied from the first memory after the first memory stores the data to be supplied to the left part; and outputting the data stored in the first memory and the data stored in the second memory by transmitting a reading signal to the first memory and the second memory at the same time.

One embodiment of the present invention provides a method of driving an organic light emitting display having a display region divided into a left part and a right part. The method includes: storing odd numbered data to be supplied to the left part in a first memory in response to a writing signal; storing odd numbered data to be supplied to the right part in a second memory in response to a carry signal supplied from the first memory after the first memory stores the odd numbered data for the left part; storing even numbered data to be supplied to the left part in a third memory in response to a writing signal; storing even numbered data to be supplied to the right part in a fourth memory in response to a carry signal supplied from the third memory after the third memory stores the even numbered data for the left part; and outputting the data stored in the first, second, third, and fourth memories by transmitting a reading signal to the first, second, third, and fourth memories, respectively.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Hereinafter, certain exemplary embodiments according to the present invention will be described with reference to the accompanying drawings. The exemplary embodiments of the present invention are provided to be readily understood by those skilled in the art.

Figure 5:
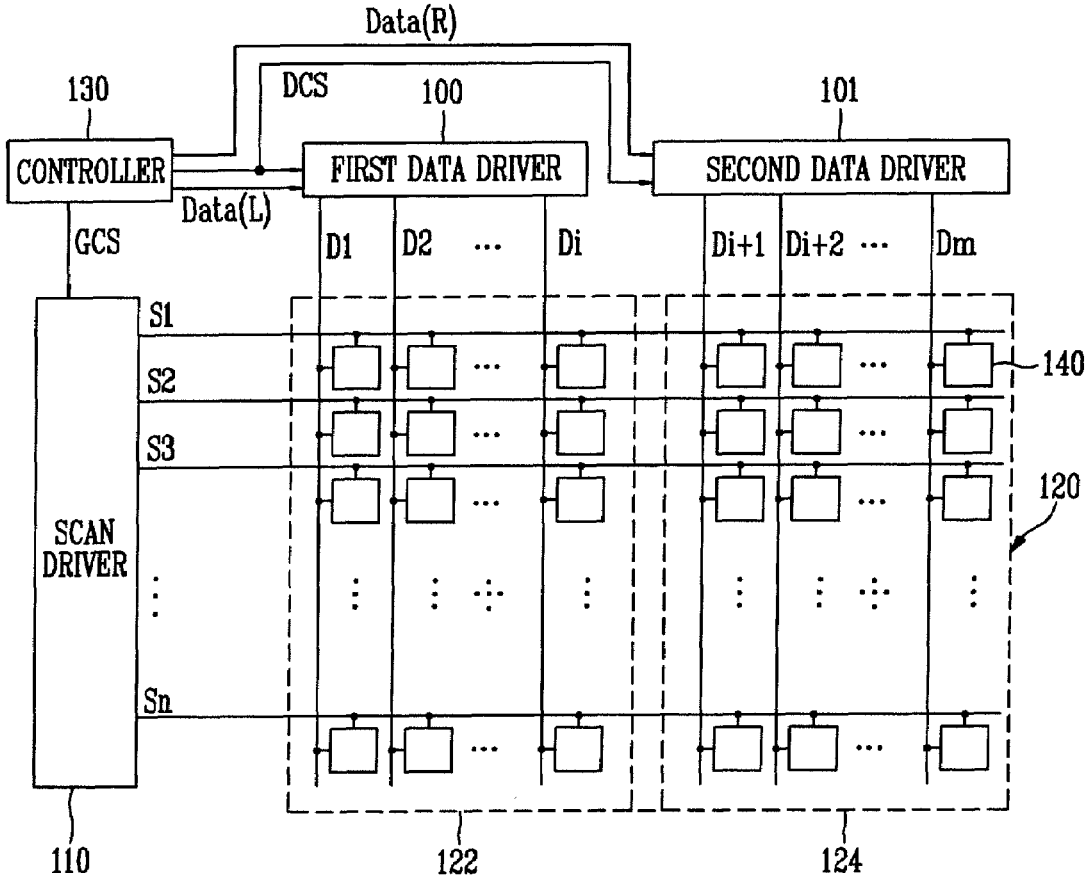
FIG. 5 illustrates an organic light emitting display according to a first embodiment of the present invention.

FIG. 5 illustrates an organic light emitting display according to a first embodiment of the present invention.

Referring to FIG. 5, the organic light emitting display according to the first embodiment of the present invention includes a display region 120 having a plurality of pixels 140 formed adjacent to respective regions where a plurality of scan lines S1 through Sn and a plurality of data lines D1 through Dm crossed each other, where n and m are natural numbers; a scan driver 110 adapted to drive the scan lines S1 through Sn; first and second data drivers 100 and 101 adapted to drive the data lines D1 through Dm; and a controller 130 adapted to control the scan driver 110 and the first and second data drivers 100 and 101.

The scan driver 110 generates a scan signal(s) for driving the scan lines S1 through Sn in response to a scan control signal(s) GCS transmitted from the controller 130, and supplies the scan signals to the scan lines S1 through Sn in sequence.

In operation, a pixel 140 is selected when a scan signal is transmitted to a scan line S, and emits light corresponding to a data signal transmitted to a data line D. For this, each pixel 140 includes at least one switching device and a capacitor.

A display region 120 includes the plurality of pixels 140. Further, the display region 120 is driven as it is divided into a left part 122 and a right part 124. The left part 122 includes a first data line D1 through the $i^{th}$ data line Di, where i is m/2. The right part 124 includes the $(i+1)^{th}$ data line Di+1 through the $m^{th}$ data line Dm.

The first and second data drivers 100 and 101 receive data control signals DCS and data Data from the controller 130. Then, the first and second data drivers 100 and 101 are controlled by the data control signals DCS to convert the data Data into voltage (or current), thereby outputting a data signal (s) to the data lines D1 through Dm. At this time, the first data driver 100 supplies the data signal to the first data line D1 through the $i^{th}$ data line Di included in the left part 122, and the second data driver 101 supplies the data signal to the $(i+1)^{th}$ data line Di+1 through the $m^{th}$ data line Dm included in the right part 124.

The controller 130 generates the data control signals DCS and the scan control signal(s) GCS in response to external synchronization signals. Here, the data control signals DCS are transmitted to the first and second data drivers 100 and 101, and the scan control signal GCS is transmitted to the scan driver 110.

Figure 6A:
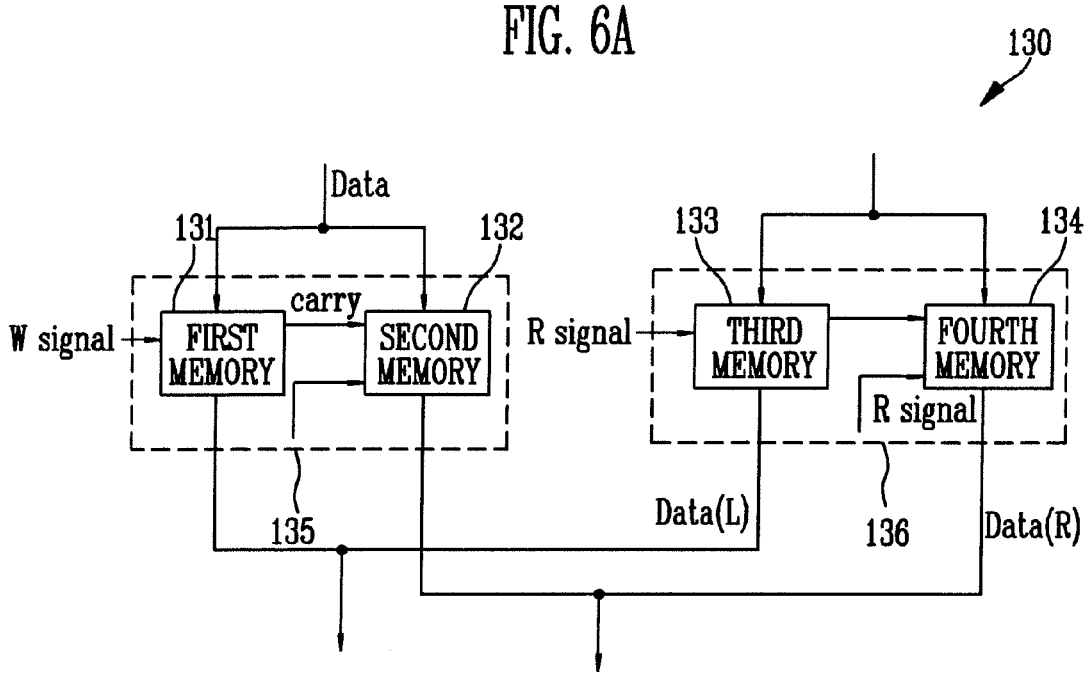
FIGS. 6A and 6B illustrate line memories provided in a controller of FIG. 5.

Further, the controller 130 temporarily stores external data Data, and supplies the stored data Data (L) and Data (R) to the first and second data drivers 100 and 101. For this, the controller 130 includes line memory blocks 135 and 136 as shown in FIG. 6A. Additionally, the temporarily stored data Data can be supplied from the controller 130 to a gamma generator (not shown). Then, the gamma generator generates the data signal in response to a gradation level of the data Data, and supplies the data signal to the first and second data drivers 100 and 101. In this embodiment, the memory blocks 135 and 136 are provided in the controller 130 for exemplary purpose and the present invention is not thereby limited. For example, in one embodiment, the memory blocks are provided outside the controller 130.

Figure 6B:
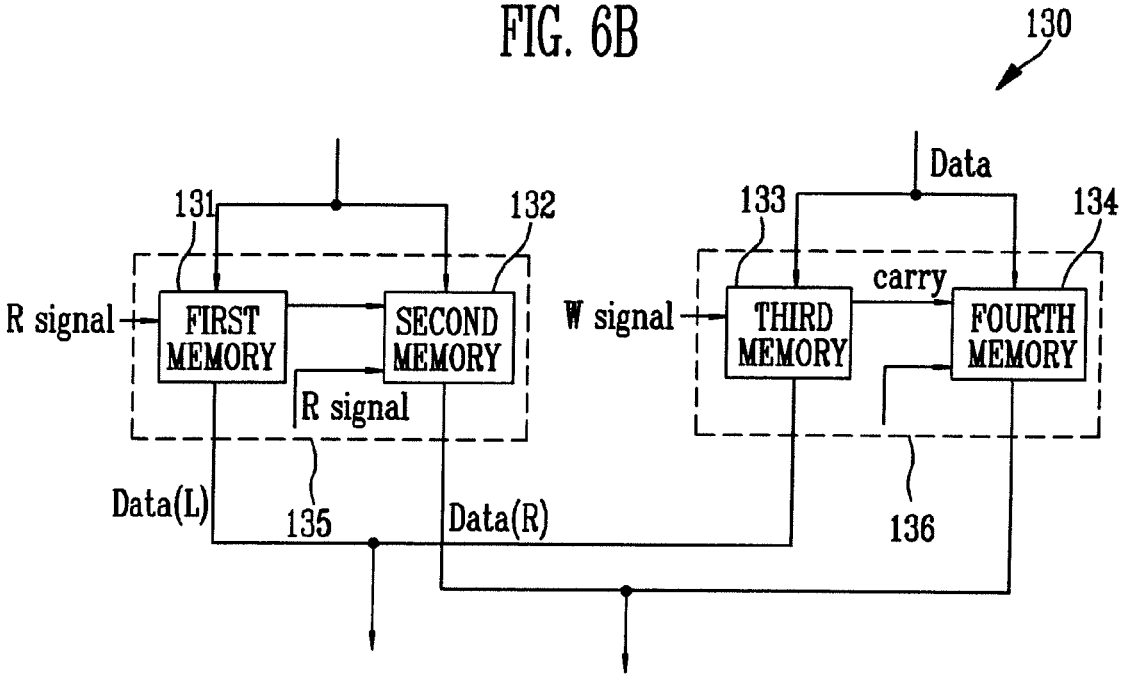

FIGS. 6A and 6B illustrate line memory blocks provided in a controller of FIG. 5.

Referring to FIGS. 6A and 6B, the controller 130 includes the first line memory block 135 and the second line memory block 136. The first line memory block 135 includes a first memory 131 and a second memory 132. Each of the first and second memories 131 and 132 is set to have a certain capacity to store data corresponding to a half horizontal line. In other words, the capacity of the first memory 131 is set to store the data Data(L) to be supplied to the left part 122 of the display region 120, and the capacity of the second memory 132 is set to store the data Data(R) to be supplied to the right part 124 of the display region 120.

The second line memory block 136 includes a third memory 133 and a fourth memory 134. Each of the third and fourth memories 133 and 134 is set to have capacity to store data corresponding to a half horizontal line. In other words, the capacity of the third memory 133 is set to store the data Data(L) to be supplied to the left part 122, and the capacity of the fourth memory 134 is set to store the data Data(R) to be supplied to the right part 124. Here, the first and second memories 131 and 132, and the third and fourth memories 133 and 134 repeatedly alternate between reading and writing operations.

For example, as shown in FIG. 6A, while a writing signal W is transmitted to the first memory 131, a reading signal R is transmitted to the third and fourth memories 133 and 134. Here, the writing signal W and the reading signal R include various signals such as an address signal, a clock signal, etc. When the writing signal W is transmitted to the first memory 131, the first memory 131 stores data Data(L) to be supplied to the left part 122 of external data Data in sequence. When the first memory 131 completely stores the data Data(L) to be supplied to the left part 122, the first memory 131 transmits a carry signal to the second memory 132. After receiving the carry signal, the second memory 132 stores data Data(R) to be supplied to the right part 124 of the external data Data in sequence. In FIG. 6A, the writing signal W is supplied to the first line memory block 135 in series.

When the reading signal R is transmitted to the third memory 133, the third memory 133 supplies the data Data(L) stored therein for the left part 122 to the first data driver 100. Here, the third memory 133 either outputs the data Data(L) for the left part 122 at the same time or in sequence. Further, when the reading signal R is transmitted to the fourth memory 134, the fourth memory 134 supplies the data Data(R) stored therein for the right part 124 to the second data driver 101. Here, the fourth memory 134 either outputs the data Data(R) for the right part 124 at the same time or in sequence. In FIG. 6A, the reading signal R is supplied to the second line memory block 136 in parallel.

Then, as shown in FIG. 6B, while the reading signal R is transmitted to the first and second memories 131 and 132, the writing signal W is transmitted to the third memory 133. When the reading signal R is transmitted to the first memory 131, the first memory 131 supplies the data Data(L) stored during a previous horizontal period for the left part 122 to the first data driver 100. Here, the first memory 131 either outputs the data Data(L) for the left part 122 at the same time or in sequence. Further, when the reading signal R is transmitted to the second memory 132, the second memory 132 supplies the data Data(R) stored therein for the right part 124 to the second data driver 101. Here, the second memory 132 either outputs the data Data(R) for the right part 124 at the same time or in sequence. In FIG. 6B, the reading signal R is supplied to the first line memory block 135 in parallel.

When the writing signal W is transmitted to the third memory 133, the third memory 133 stores data Data(L) to be supplied to the left part 122 of the external data Data in sequence. When the third memory 133 completely stores the data Data(L) to be supplied to the left part 122, the third memory 133 transmits the carry signal to the fourth memory 134. After receiving the carry signal, the fourth memory 134 stores data Data(R) to be supplied to the right part 124 of the external data Data in sequence. In FIG. 6B, the writing signal W is supplied to the second line memory block 136 in series.

Figure 1:
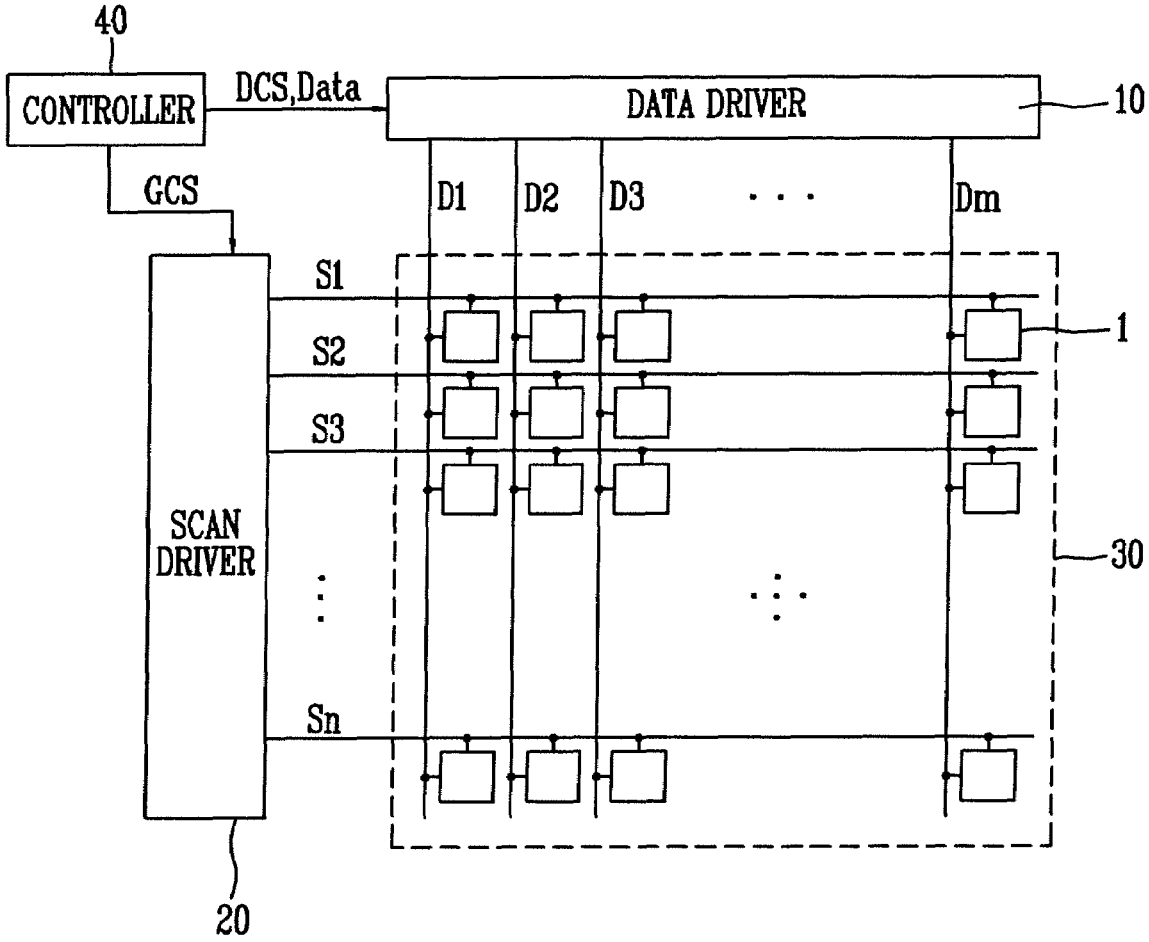
FIG. 1 (PRIOR ART)
FIG. 1 illustrates a conventional organic light emitting display.
Figure 2A:
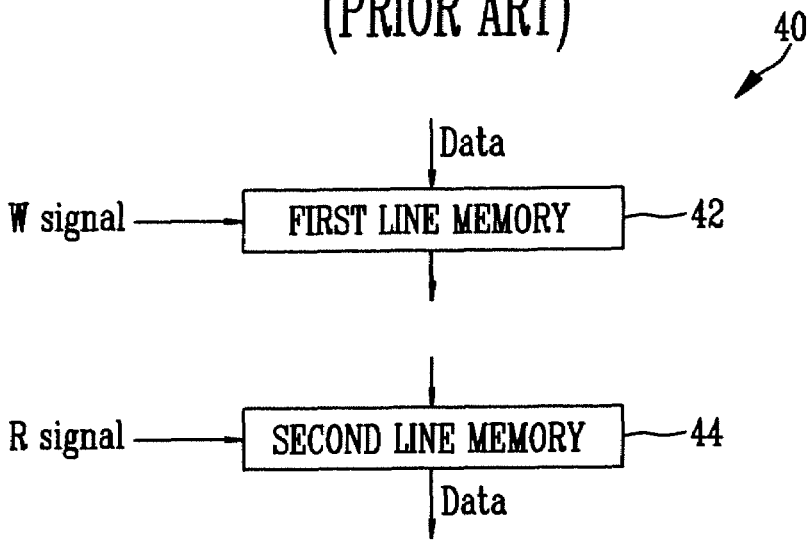
FIG. 2A (PRIOR ART)
FIGS. 2A and 2B illustrate line memories provided in a controller of FIG. 1.
Figure 2B:
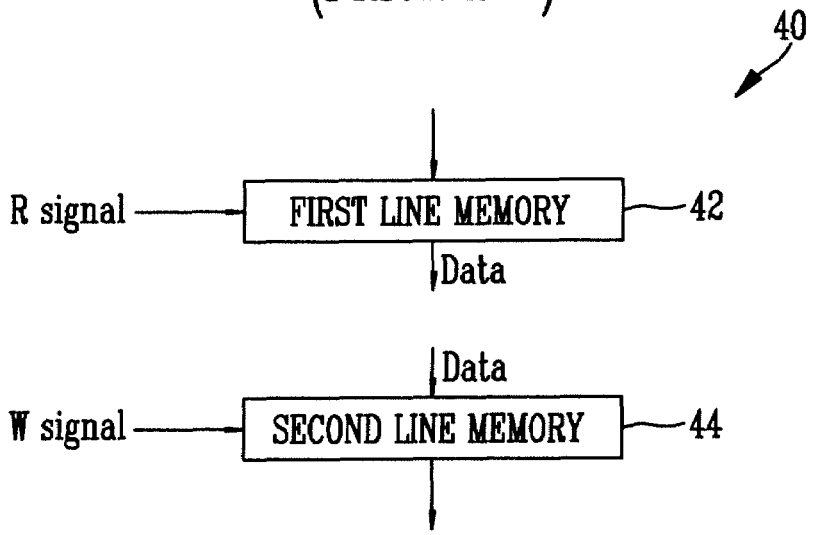
FIG. 2B (PRIOR ART)
Figure 3:
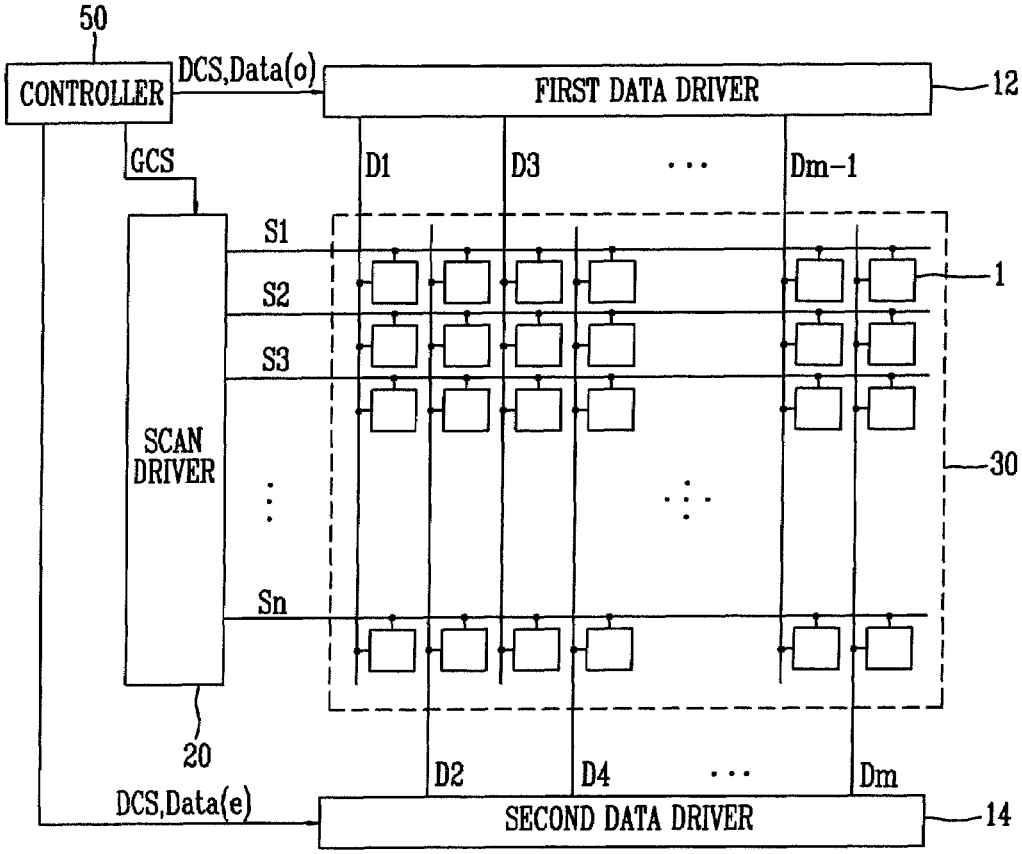
FIG. 3 (PRIOR ART)
FIG. 3 illustrates another conventional organic light emitting display.
Figure 4A:
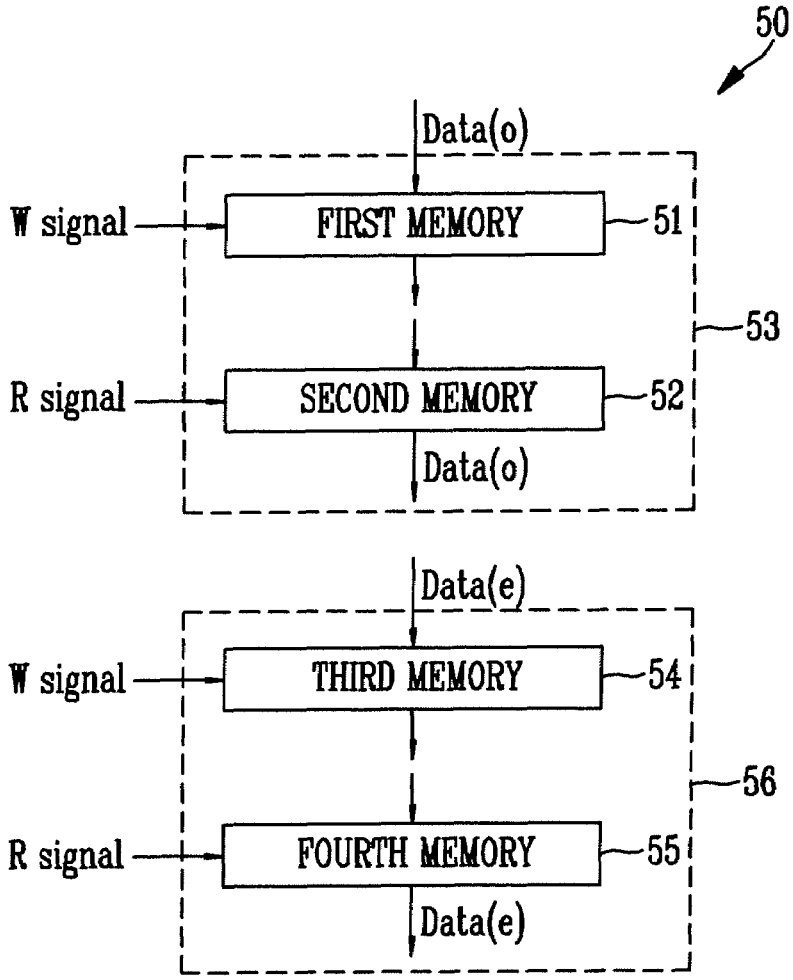
FIG. 4A (PRIOR ART)
FIGS. 4A and 4B illustrate line memories provided in a controller of FIG. 3.
Figure 4B:
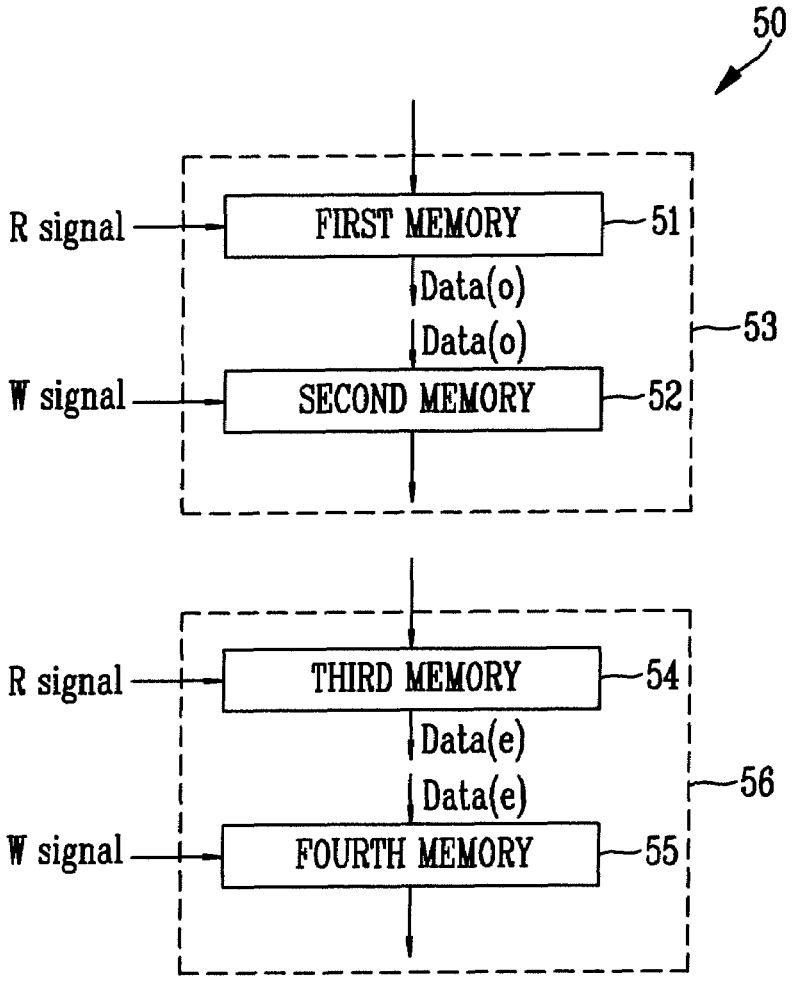
FIG. 4B (PRIOR ART)

According to the first embodiment of the present invention, the reading signal R clock is supplied to the memories provided in each line memory blocks 135 and 136 in parallel (or at the same time), and the writing signal W clock is supplied to the memories provided in each line memory blocks 135 and 136 in series. Thus, the reading signal R clock is supplied to the memories provided in each line memory blocks 135 and 136, so that the frequency of the clock included in reading signal R can be advantageously lowered by about half as compared with the conventional organic light emitting display of FIG. 1.

Accordingly, as the frequency of the clock included in reading signal R can be advantageously lowered by about half as compared with the conventional organic light emitting display, an electromagnetic interference (EMI) is decreased. Further, accordingly, as the frequency of the clock included in reading signal R can be advantageously lowered by about half as compared with the conventional organic light emitting display, it is possible to employ an integrated chip (IC) or the like operating in low frequency, thereby reducing a production cost of the organic light emitting display. According to the first embodiment of the present invention, the display region 120 is divided into the left part 122 and the right part 124, so that the picture quality is prevented from being deteriorated by a unit of a vertical line, and at the same time an interference between adjacent data lines D due to a capacitance effect is minimized.

Figure 7:
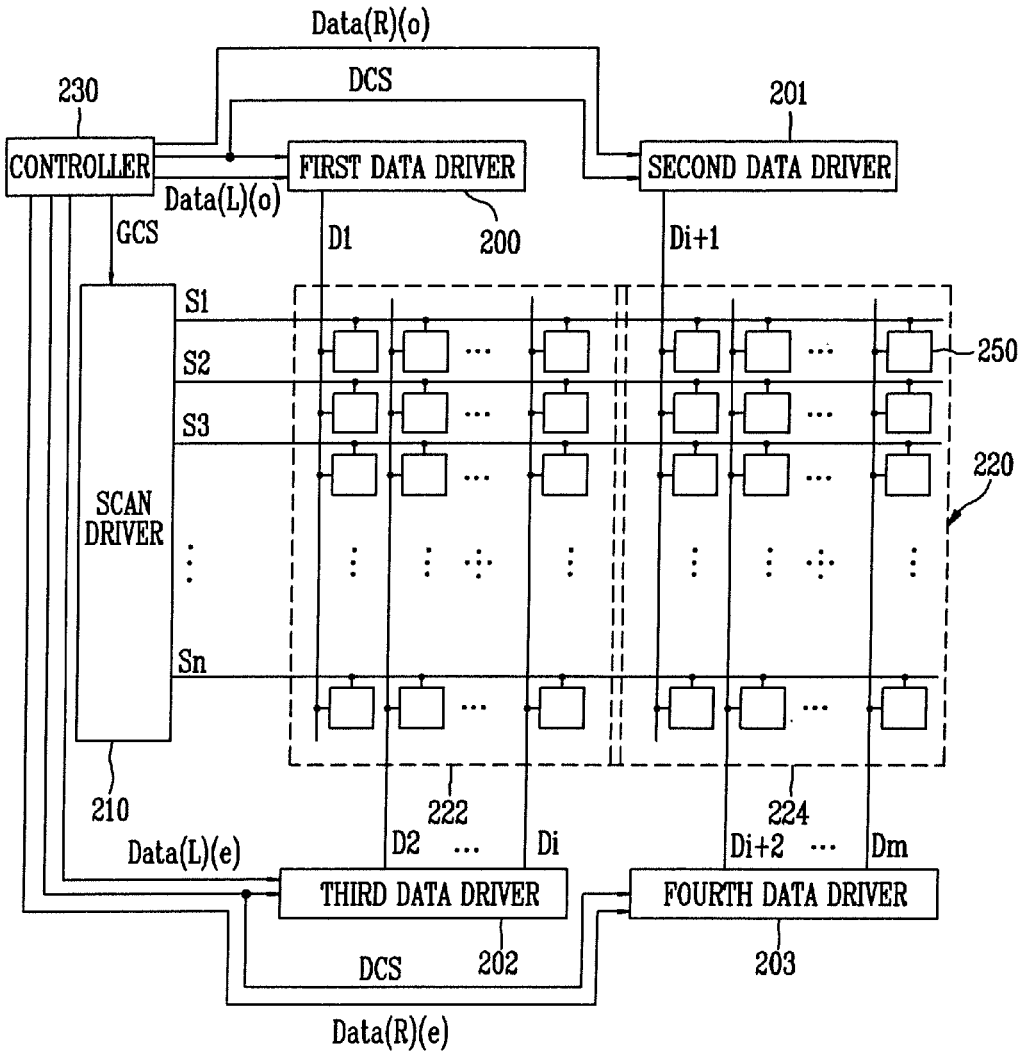
FIG. 7 illustrates an organic light emitting display according to a second embodiment of the present invention.

FIG. 7 illustrates an organic light emitting display according to a second embodiment of the present invention.

Referring to FIG. 7, the organic light emitting display according to the second embodiment of the present invention includes a display region 220 having a plurality of pixels 250 formed adjacent to respective regions where a plurality of scan lines S1 through Sn and a plurality of data lines D1 through Dm crossed each other, where n and m are natural numbers; a scan driver 210 adapted to drive the scan lines S1 through Sn; first, second, third, and fourth data drivers 200, 201, 202, and 203 to drive the data lines D1 through Dm; and a controller 230 adapted to control the scan driver 210 and the first through fourth data drivers 200 through 203.

The scan driver 210 generates a scan signal(s) for driving the scan lines S1 through Sn in response to a scan control signal(s) GCS transmitted from the controller 230, and supplies the scan signals to the scan lines S1 through Sn in sequence.

In operation, a pixel 250 is selected when a scan signal is transmitted to a scan line S, and emits light corresponding to a data signal transmitted to a data line D. For this, each pixel 250 includes at least one switching device and a capacitor.

A display region 220 includes the plurality of pixels 250. Further, the display region 220 is driven as it is divided into a left part 222 and a right part 224. The left part 222 includes a first data line D1 through the $i^{th}$ data line Di. The right part 224 includes the $(i+1)^{th}$ data line Di+1 through the $m^{th}$ data line Dm.

The first data driver 200 receives data control signals DCS and odd numbered data Data (L)(o) for the left part 222 from the controller 230. The second data driver 201 receives the data control signals DCS and odd numbered data Data (R)(o) for the right part 224 from the controller 230. The third data driver 202 receives the data control signals DCS and even numbered data Data (L)(e) for the left part 222 from the controller 230. The fourth data driver 203 receives the data control signals DCS and even numbered data Data (R)(e) for the right part 224 from the controller 230.

The first through fourth data drivers 200 through 203 are controlled by the data control signals DCS to convert the data Data into voltage (or current), thereby outputting a data signal (s) to the data lines D1 through Dm. At this time, the first through fourth data drivers 200 through 203 supply the data signal to the data lines D1 through Dm per one horizontal period.

The controller 230 generates the data control signals DCS and the scan control signal(s) GCS in response to external synchronization signals. Here, the data control signals DCS are transmitted to the first through fourth data drivers 200 through 203, and the scan control signal GCS is transmitted to the scan driver 210.

Figure 8A:
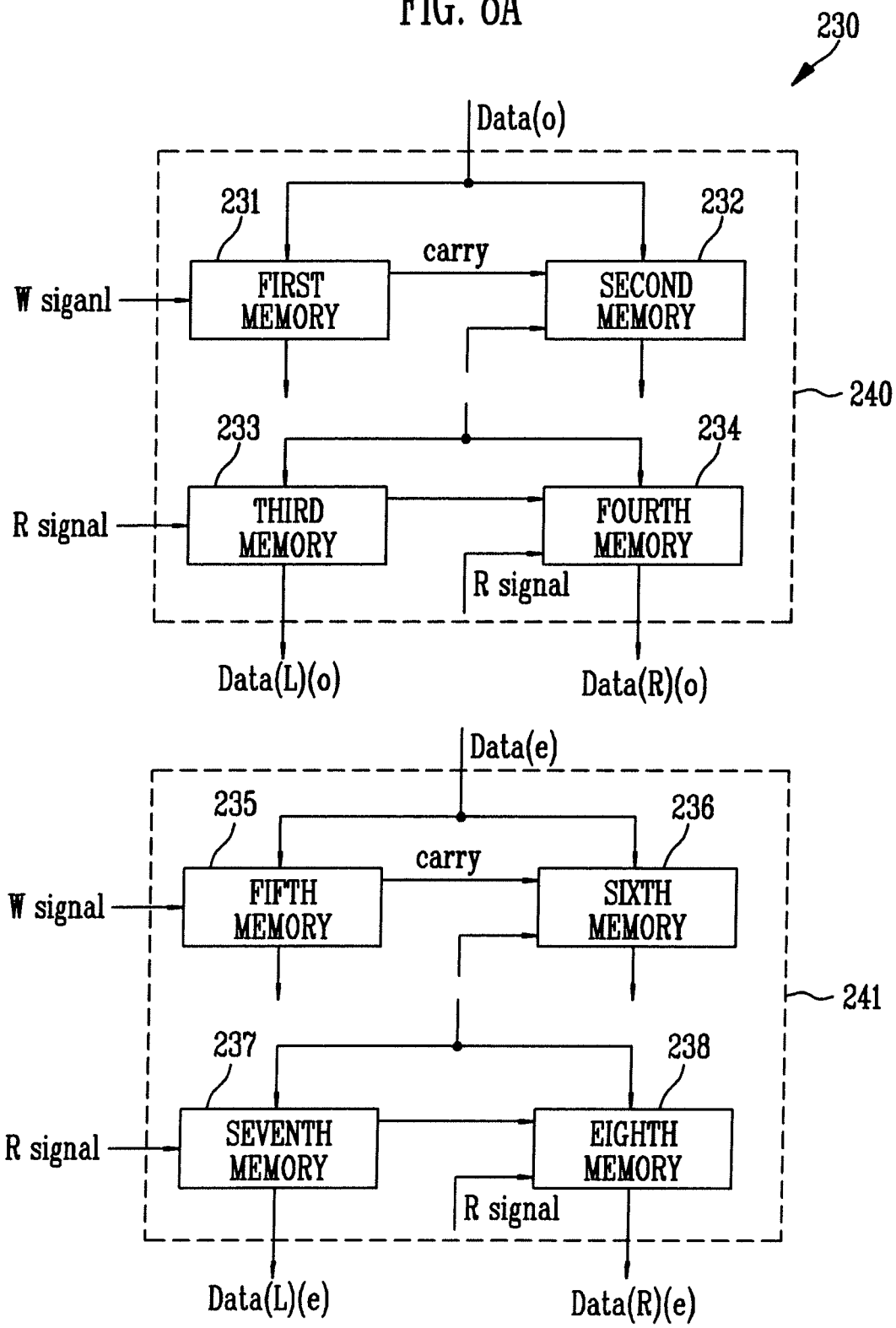
FIGS. 8A and 8B illustrate line memories provided in a controller of FIG. 7.

Further, the controller 230 temporarily stores external data Data, and supplies the stored data Data (L)(o), Data (R)(o), Data (L)(e), and Data (R)(e) to the first through fourth data drivers 200 through 203. For this, the controller 230 includes line memory blocks 240 and 241 as shown in FIG. 8A. Additionally, the temporarily stored data Data can be supplied from the controller 230 to a gamma generator (not shown). Then, the gamma generator generates the data signal in response to a gradation level of the data Data, and supplies the data signal to the first through fourth data drivers 200 through 203. In this embodiment, the line memory blocks 240 and 241 are provided in the controller 230 for exemplary purposes and the present invention is not thereby limited. For example, in one embodiment, the memory blocks are provided outside the controller 230.

Figure 8B:
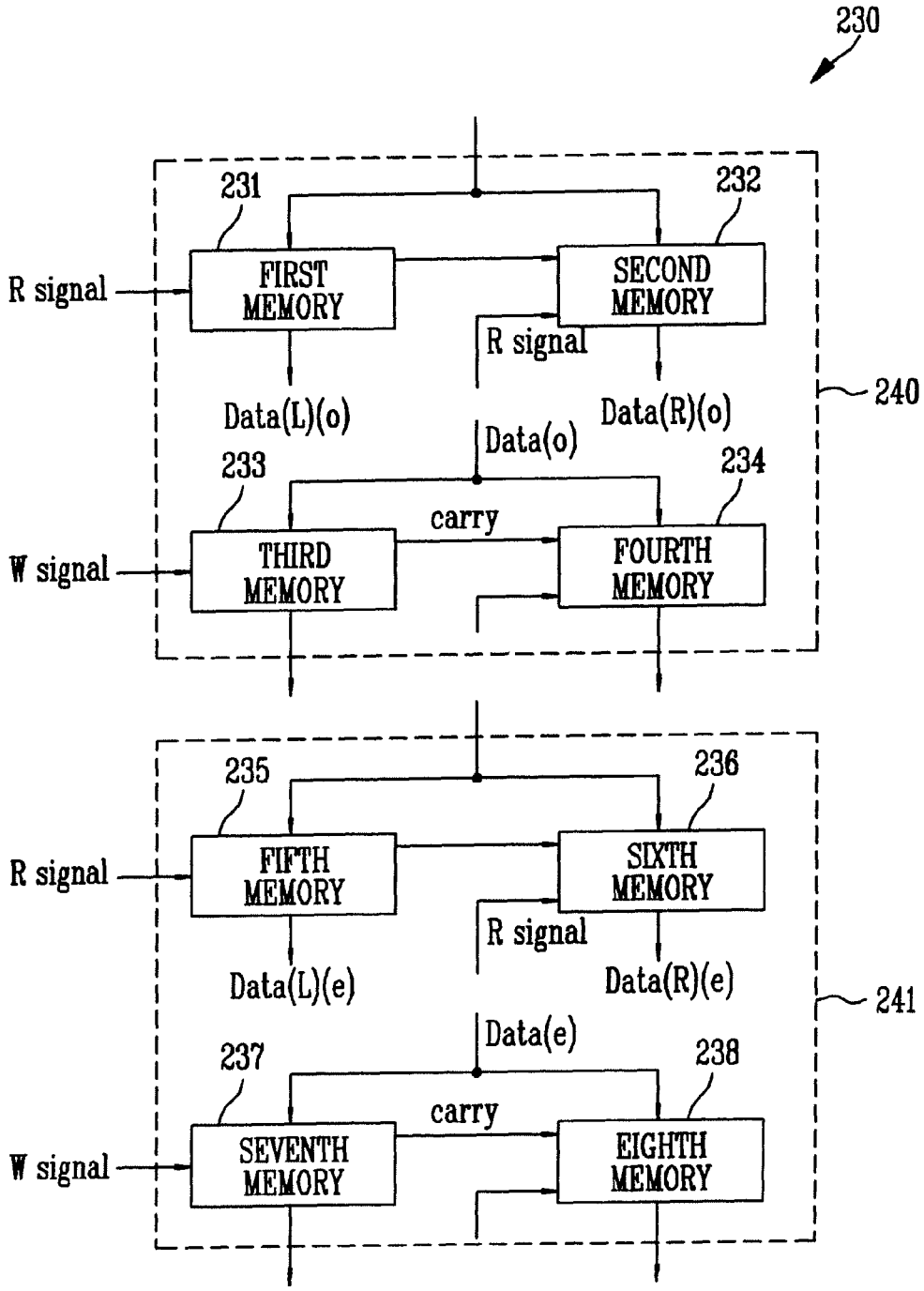

FIGS. 8A and 8B illustrate line memory blocks provided in a controller of FIG. 7.

Referring to FIGS. 8A and 8B, the controller 230 includes the first line memory block 240 and the second line memory block 241. The first line memory block 240 includes a first memory 231, a second memory 232, a third memory 233, and a fourth memory 234. Each of the first through fourth memories 231 through 233 is set to have a certain capacity to store data corresponding to a quarter horizontal line. In other words, the capacity of each of the first and third memories 231 and 233 is set to store the odd numbered data Data(L)(o) for the left part 222, and the capacity of each of the second and fourth memories 232 and 234 is set to store the odd numbered data Data(R)(o) for the right part 224.

The second line memory block 241 includes a fifth memory 235, a sixth memory 236, a seventh memory 237, and an eighth memory 238. Each of the fifth through eighth memories 235 through 238 is set to have a certain capacity to store data Data corresponding to a quarter horizontal line. In other words, the capacity of each of the fifth and seventh memories 235 and 237 is set to store the even numbered data Data(L)(e) for the left part 222, and the capacity of each of the sixth and eighth memories 236 and 238 is set to store the even numbered data Data(R)(e) for the right part 224.

For example, as shown in FIG. 8A, while a writing signal W is transmitted to the first and fifth memories 231 and 235, a reading signal R is transmitted to the third, fourth, seventh and eighth memories 233, 234, 237 and 238. When the writing signal W is transmitted to the first memory 231, the first memory 231 stores the odd numbered data Data(L)(o) for the left part 222 of external data Data in sequence. When the first memory 231 completely stores the odd numbered data Data (L)(o) for the left part 222, the first memory 231 transmits a carry signal to the second memory 232. After receiving the carry signal, the second memory 232 stores the odd numbered data Data(R)(o) for the right part 224 of the external data Data in sequence.

When the writing signal W is transmitted to the fifth memory 235, the fifth memory 235 stores the even numbered data Data(L)(e) for the left part 222 of the external data Data in sequence. When the fifth memory 235 completely stores the even numbered data Data(L)(e) for the left part 222, the fifth memory 235 transmits a carry signal to the sixth memory 236. After receiving the carry signal, the sixth memory 236 stores the even numbered data Data(R)(e) for the right part 224 of the external data Data in sequence.

When the reading signal R is transmitted to the third memory 233, the third memory 233 supplies the odd numbered data Data(L)(o) stored therein for the left part 222 to the first data driver 200. Here, the third memory 233 either outputs the odd numbered data Data(L)(o) for the left part 222 at the same time or in sequence.

When the reading signal R is transmitted to the fourth memory 234, the fourth memory 234 supplies the odd numbered data Data(R)(o) stored therein for the right part 224 to the second data driver 201. Here, the fourth memory 234 either outputs the odd numbered data Data(R)(o) for the right part 224 at the same time or in sequence.

When the reading signal R is transmitted to the seventh memory 237, the seventh memory 237 supplies the even numbered data Data(L)(e) stored therein for the left part 222 to the third data driver 202. Here, the seventh memory 237 either outputs the even numbered data Data(L)(e) for the left part 222 at the same time or in sequence.

When the reading signal R is transmitted to the eighth memory 238, the eighth memory 238 supplies the even numbered data Data(R)(e) stored therein for the right part 224 to the fourth data driver 203. Here, the eighth memory 238 either outputs the even numbered data Data(R)(e) for the right part 224 at the same time or in sequence.

Then, as shown in FIG. 8B, while the reading signal R is transmitted to the first, second, fifth and sixth memories 231, 232, 235 and 236, the writing signal W is transmitted to the third and seventh memories 233 and 237.

When the writing signal W is transmitted to the third memory 233, the third memory 233 stores the odd numbered data Data(L)(o) for the left part 222 of external data Data in sequence. When the third memory 233 completely stores the odd numbered data Data(L)(o) for the left part 222, the third memory 233 transmits the carry signal to the fourth memory 234. After receiving the carry signal, the fourth memory 234 stores the odd numbered data Data(R)(o) for the right part 224 of the external data Data in sequence.

When the writing signal W is transmitted to the seventh memory 237, the seventh memory 237 stores the even numbered data Data(L)(e) for the left part 222 of the external data Data in sequence. When the seventh memory 237 completely stores the even numbered data Data(L)(e) for the left part 222, the seventh memory 237 transmits the carry signal to the eighth memory 238. After receiving the carry signal, the eighth memory 238 stores the even numbered data Data(R)(e) for the right part 224 of the external data Data in sequence.

When the reading signal R is transmitted to the first memory 231, the first memory 231 supplies the odd numbered data Data(L)(o) stored therein for the left part 222 to the first data driver 200. Here, the first memory 231 either outputs the odd numbered data Data(L)(o) for the left part 222 at the same time or in sequence.

When the reading signal R is transmitted to the second memory 232, the second memory 232 supplies the odd numbered data Data(R)(o) stored therein for the right part 224 to the second driver 201. Here, the second memory 232 either outputs the odd numbered data Data(R)(o) for the right part 224 at the same time or in sequence.

When the reading signal R is transmitted to the fifth memory 235, the fifth memory 235 supplies the even numbered data Data(L)(e) stored therein for the left part 222 to the third data driver 202. Here, the fifth memory 235 either outputs the even numbered data Data(L)(e) for the left part 222 at the same time or in sequence.

When the reading signal R is transmitted to the sixth memory 236, the sixth memory 236 supplies the even numbered data Data(R)(e) stored therein for the right part 224 to the fourth data driver 203. Here, the sixth memory 236 either outputs the even numbered data Data(R)(e) for the right part 224 at the same time or in sequence.

According to the second embodiment of the present invention, the display region 220 is driven as it is divided into the left part 222 and the right part 224. Further, according to the second embodiment of the present invention, the data line D is driven as it is divided into the odd numbered data lines D1, D3, . . . , Dm−1, and the even numbered data lines D2, D4, . . . , Dm.

Here, the first memory 231 and the third memory 233 store the odd numbered data Data(L)(o) therein for the left part 222 and supply the stored odd numbered data Data(L)(o) to the left part 222. The fifth memory 235 and the seventh memory 237 store the even numbered data Data(L)(e) therein for the left part 222 and supply the stored even numbered data Data (L)(e) to the left part 222. The second memory 232 and the fourth memory 234 store the odd numbered data Data(R)(o) therein for the right part 224 and supply the stored odd numbered data Data(R)(o) to the right part 224. The sixth memory 236 and the eight memory 238 store the even numbered data Data(R)(e) therein for the right part 224 and supply the stored even numbered data Data(R)(e) to the right part 224.

Further, the frequency of the writing signal W is set to store the odd numbered data Data(o) or the even numbered data Data(e) in sequence. Thus, the frequency of the clock included in the writing signal W is lowered by about half as compared with the conventional organic light emitting display of FIG. 1. Further, the reading signal R is set to output the odd numbered data for the left part 222, the even numbered data for the left part 222, the odd numbered data for the right part 224, and the even numbered data for the right part 224, which are previously stored in the respective memories. Thus, the frequency of the clock included in the reading signal R is lowered by about a quarter as compared with the conventional organic light emitting display of FIG. 1.

According to the second embodiment of the present invention, the writing signal W and the reading signal R are set to have relatively low frequency, so that an EMI is decreased. Further, since the writing signal W and the reading signal R are set to have a relatively low frequency, it is possible to employ an integrated chip (IC) or the like operating in low frequency, thereby reducing a production cost of the organic light emitting display.

As described above, the present invention provides an organic light emitting display and a method of driving the same, in which data is divided and supplied corresponding to a left part and a right part of a panel, so that the frequency of a clock included in a reading signal supplied to a line memory is lowered, thereby reducing a production cost.

Further, the present invention provides an organic light emitting display and a method of driving the same, in which data is divided and supplied corresponding to a left part and a right part of a panel and at the same time corresponding to an odd numbered data line and an even numbered data line, so that the frequencies of clocks included in a reading signal and a writing signal supplied to a line memory are lowered, thereby reducing a production cost.

Although certain embodiments of the present invention have been shown and described, it would be appreciated by those skilled in the art that changes might be made in these embodiments without departing from the principles and spirit of the invention, the scope of which is defined in the claims and their equivalents.

What is claimed is:

1. An organic light emitting display comprising:

a display region divided into a left part and a right part;

a first data driver adapted to supply a data signal to odd numbered data lines corresponding to the left part;

a second data driver adapted to supply the data signal to odd numbered data lines corresponding to the right part;

a third data driver adapted to supply the data signal to even numbered data lines corresponding to the left part;

a fourth data driver adapted to supply the data signal to even numbered data lines corresponding to the right part; and a controller comprising:

a first line memory block adapted to store only odd numbered data to be supplied to the left and right parts in sequence in response to a writing signal and to output odd numbered data stored therein for the left and right parts at the same time in response to a reading signal, the first line memory block comprising a first memory adapted to store the odd numbered data for the left part and output directly to the first data driver, and a second memory adapted to store the odd numbered data for the right part and output directly to the second data driver; and a second line memory block adapted to store only even numbered data to be supplied to the left and right parts in sequence in response to the writing signal and to output even numbered data stored therein for the left and right parts at the same time in response to the reading signal, the second line memory block comprising a third memory adapted to store the even numbered data for the left part and output directly to the third data driver, and a fourth memory adapted to store the even numbered data for the right part and output directly to the fourth data driver;

wherein the first line memory block comprises: first and third sub-memories in the first memory, adapted to store the odd numbered data for the left part in response to the writing signal and to supply the odd numbered data for the left part to the first data driver in response to the reading signal; and second and fourth sub-memories in the second memory, adapted to store the odd numbered data for the right part in response to a carry signal respectively supplied from the first memory and the third memory and to supply the odd numbered data for the right part to the second data driver in response to the reading signal.

2. The organic light emitting display according to claim 1, wherein the second line memory block comprises:

fifth and seventh sub-memories in the third memory adapted to store the even numbered data for the left part in response to the writing signal and to supply the even numbered data for the left part to the third data driver in response to the reading signal; and sixth and eighth sub-memories in the fourth memory adapted to store the even numbered data for the right part in response to a carry signal respectively supplied from the fifth memory and the seventh memory and to supply the even numbered data for the right part to the fourth data driver in response to the reading signal.

3. The organic light emitting display according to claim 1, wherein a clock frequency of the reading signal is set to be lower than a clock frequency of the writing signal.

4. A method of driving an organic light emitting display comprising a display region divided into a left part and a right part, and a controller comprising a first memory, a second memory, a third memory, and a fourth memory, the method comprising:

storing only odd numbered data to be supplied to the left part in the first memory in response to a writing signal;

storing only odd numbered data to be supplied to the right part in the second memory in response to a carry signal supplied from the first memory after the first memory stores the odd numbered data from the left part;

storing only even numbered data to be supplied to the left part in the third memory in response to a writing signal;

storing only even numbered data to be supplied to the right in the fourth memory in response to a carry signal supplied from the third memory after the third memory stores the even numbered data for the left part;

outputting the data stored in the first memory directly to a first data driver corresponding to the odd numbered data for the left part by transmitting a reading signal to the first memory;

outputting the data stored in the second memory directly to a second data driver corresponding to the odd numbered data for the right part by transmitting a reading signal to the second memory;

outputting the data stored in the third memory directly to a third data driver corresponding to the even numbered data for the left part by transmitting a reading signal to the third memory;

outputting the data stored in the fourth memory directly to a fourth data driver corresponding to the even numbered data for the right part by transmitting a reading signal to the fourth memory;

wherein the data stored in the first and second memories are outputted at the same time, and the data stored in the third and fourth memories are outputted at the same time, allowing a fifth memory to store and output directly to the first data driver the odd numbered data for the left part alternately with the first memory;

allowing a sixth memory to store and output directly to the second data driver the odd numbered data for the right part alternately with the second memory;

allowing a seventh memory to store and output directly to the third data driver the even numbered data for the left part alternately with the third memory; and allowing an eighth memory to store and output directly to the fourth data driver the even numbered data for the right part alternately with the fourth memory.

5. The method according to claim 4, wherein each of the first, second, third, and fourth memories outputs the data stored therein at the same time when receiving the reading signal.

* * * * *

UNITED STATES PATENT AND TRADEMARK OFFICE

CERTIFICATE OF CORRECTION

PATENT NO. : 8,537,170 B2
APPLICATION NO. : 12/265718
DATED : September 17, 2013
INVENTOR(S) : Do Hyung Ryu It is certified that error appears in the above-identified patent and that said Letters Patent is hereby corrected as shown below:

In the Claims

| | |
|---|---|
| Col. 14, line 14, Claim 4 | Delete "the right",<br>Insert --the right part-- |
| Col. 14, line 29, Claim 4 | Delete "memory;",<br>Insert --memory; and-- |

Signed and Sealed this
Sixth Day of January, 2015

Michelle K. Lee

Michelle K. Lee
*Deputy Director of the United States Patent and Trademark Office*